US010316636B2

(12) United States Patent
Fonseca et al.

(10) Patent No.: US 10,316,636 B2
(45) Date of Patent: Jun. 11, 2019

(54) METHOD OF TREATING A SUBTERRANEAN FORMATION WITH A MORTAR SLURRY DESIGNED TO FORM A PERMEARLE MORTAR

(71) Applicant: Shell Oil Company, Houston, TX (US)

(72) Inventors: Ernesto Rafael Fonseca, Houston, TX (US); Arthur Herman Hale, Houston, TX (US); Mauricio Jose Farinas Moya, Houston, TX (US); Guy Lode Magda Maria Verbist, Amsterdam (NL); Gerardus Johannes Leonardus Van Der Wegen, Sittard (NL); Henricus Van Selst, Sittard (NL)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 13/923,238

(22) Filed: Jun. 20, 2013

(65) Prior Publication Data

US 2013/0341024 A1 Dec. 26, 2013

Related U.S. Application Data

(60) Provisional application No. 61/662,705, filed on Jun. 21, 2012.

(51) Int. Cl.
*E21B 43/26* (2006.01)

(52) U.S. Cl.
CPC ..... *E21B 43/261* (2013.01)

(58) Field of Classification Search
CPC ..... E21B 49/006; E21B 43/267
See application file for complete search history.

(56) References Cited

U.S. PATENT DOCUMENTS

| | | | | |
|---|---|---|---|---|
| 2,223,804 | A | 12/1940 | Kennedy | |
| 2,805,721 | A | 9/1957 | Maly | |
| 3,399,727 | A | 9/1968 | Graham et al. | |
| 3,654,990 | A * | 4/1972 | Harnsberger et al. | 166/281 |
| 3,654,992 | A | 4/1972 | Harnsberger et al. | 166/281 |
| 3,861,467 | A * | 1/1975 | Harnsberger | E21B 43/025 166/276 |
| 3,862,663 | A | 1/1975 | Curtice et al. | 166/276 |
| 3,948,672 | A | 4/1976 | Harnsberger | 106/90 |
| 4,358,047 | A | 11/1982 | Raubenheimer | 166/280 |
| 5,273,115 | A | 12/1993 | Spafford | |
| 5,358,047 | A * | 10/1994 | Himes et al. | 166/280.1 |
| 5,897,704 | A | 4/1999 | Baglin | 106/696 |
| 5,948,734 | A | 9/1999 | Sinclair et al. | |
| 6,202,751 | B1 | 3/2001 | Chatterji et al. | 166/276 |
| 6,251,179 | B1 * | 6/2001 | Allan | C04B 28/02 106/718 |
| 6,330,916 | B1 | 12/2001 | Rickards et al. | |
| 6,662,873 | B1 | 12/2003 | Nguyen et al. | 166/276 |
| 6,883,609 | B2 | 4/2005 | Drochon et al. | 166/292 |
| 6,938,692 | B2 | 9/2005 | Nguyen et al. | 166/278 |
| 7,032,663 | B2 | 4/2006 | Nguyen | 166/276 |
| 7,044,224 | B2 | 5/2006 | Nguyen | 166/308.1 |
| 7,353,876 | B2 * | 4/2008 | Savery et al. | 166/308.5 |
| 7,717,176 | B2 | 5/2010 | Danican et al. | 166/276 |
| 7,909,096 | B2 * | 3/2011 | Clark et al. | 166/250.17 |
| 2006/0169448 | A1 | 8/2006 | Savery et al. | |
| 2008/0135245 | A1 | 6/2008 | Smith et al. | |
| 2008/0217010 | A1 | 9/2008 | Blackburn et al. | |
| 2009/0065198 | A1 * | 3/2009 | Suarez-Rivera et al. | 166/250.1 |
| 2009/0139719 | A1 * | 6/2009 | Luo | C04B 18/021 166/280.2 |
| 2011/0081550 | A1 | 4/2011 | Sueda et al. | |

FOREIGN PATENT DOCUMENTS

| | | |
|---|---|---|
| CN | 1143992 A | 2/1997 |
| CN | 101787864 A | 7/2010 |
| WO | 2011081550 | 7/2011 |

OTHER PUBLICATIONS

PCT International Search Report, Application No. PCT/US2013/046767 dated Feb. 14, 2014.

* cited by examiner

*Primary Examiner* — Andrew Sue-Ako

(57) ABSTRACT

A method of treating a subterranean formation may include preparing a mortar slurry, injecting the mortar slurry into the subterranean formation at a pressure sufficient to create a fracture in the subterranean formation, and allowing the mortar slurry to set, forming a mortar in the fracture. The mortar slurry may be designed to form a pervious mortar, to crack under fracture closure pressure, or both.

13 Claims, No Drawings

METHOD OF TREATING A SUBTERRANEAN FORMATION WITH A MORTAR SLURRY DESIGNED TO FORM A PERMEARLE MORTAR

This patent application claims the benefit of U.S. Provisional Application 61/662,705, filed Jun. 21, 2012, which is incorporated herein by reference.

FIELD OF THE INVENTION

The invention relates to a method of treating a subterranean formation using a mortar slurry including cementitious material, water, and aggregates and optionally admixtures and/or additives.

BACKGROUND

One method of treating a subterranean formation is fracturing. Fracturing is a process of initiating and subsequently propagating a crack or fracture in a rock layer. Fracturing enables the production of hydrocarbons from rock formations deep below the earth's surface (e.g., from 2,000 to 20,000 feet). At such depth, the formation may lack sufficient porosity and permeability (conductivity) to allow hydrocarbons to flow from the rock into a wellbore at economic rates. Manmade fractures start at a predetermined depth in a wellbore drilled into the reservoir rock formation and extend outward into a targeted area of the formation. Fracturing works by providing a conductive path connecting a larger area of the reservoir to the wellbore, thereby increasing the area from which hydrocarbons can be recovered from the targeted formation. Many fractures are created by hydraulic fracturing, or injecting fluid under pressure into the wellbore. A proppant introduced into the injected fluid may maintain the fracture width. Common proppants include grains of sand, ceramic or other particulates, to prevent the fractures from closing when the injection ceases. Some proppant materials are expensive and may be unsuitable for maintaining initial conductivity. The transport of the proppant materials can be costly, and ineffective. For example, proppant can have a tendency to settle in slick water jobs having short fracture lengths. Additionally, Slick water fracturing jobs demands the use of vast amounts of water and hydraulic horsepower. Gel jobs have also difficulties associated with proper clean up due to residue that contaminates the reservoir, impairing production, and the inability to stay functional (high viscosity) for long periods of time (5 to 24 hours) in formations that are tight and have long fracture closure times.

A method for providing permeability in fractures is described in U.S. Pat. No. 7,044,224. The method involves injecting a permeable cement composition, including a degradable material, into a subterranean formation. The degradation of the degradable material forms voids in a resulting proppant matrix. A problem of the method is that the degradation of the degradable material is difficult to manage. If the degradable material is not mixed uniformly into the cement composition, permeability may be limited. Furthermore, when degradation occurs too quickly, the cement composition fills the voids prior to forming a matrix resulting in decreased permeability. When degradation occurs too slowly, the voids lack connectivity to one another, also resulting in decreased permeability. In order for degradation to occur at the proper time, various conditions (such as pH, temperature, pressure, etc.) must be managed carefully, adding complexity and thus time and cost to the process. Another problem of the method is that the degradable material can be expensive and difficult to transport. Yet another problem of the method is that, even when large amounts of degradable material are used, permeability is only marginally enhanced. Furthermore, the addition of degradable material can have negative impact on flowability.

SUMMARY OF THE INVENTION

A method of treating a subterranean formation may include preparing a mortar slurry, injecting the mortar slurry into the subterranean formation, maintaining the mortar slurry at a pressure higher than a fracture closure pressure of the formation while allowing the mortar slurry to set to form mortar, reducing the pressure below the fracture closure pressure, and allowing the mortar to crack. The mortar slurry may be designed to set to form the mortar with a compressive strength below the fracture closure pressure of the subterranean formation. The mortar slurry may include a cementitious material and water. The mortar slurry may be injected into the subterranean formation at a pressure sufficient to create a fracture in the subterranean formation. The pressure may be maintained while the mortar slurry is allowed to set and form the mortar in the fracture. The pressure may then be reduced below the fracture closure pressure and the mortar allowed to crack, forming a cracked mortar.

Another method of treating a subterranean formation may include preparing a mortar slurry, injecting the mortar slurry into the subterranean formation at a pressure sufficient to create a fracture in the subterranean formation, and allowing the mortar slurry to set, forming a pervious mortar in the fracture. The mortar slurry may be designed to set to form the pervious mortar with conductivity above 10 mD-ft. The mortar slurry may include a cementitious material, aggregate, and water.

DETAILED DESCRIPTION

Generally, a mortar slurry may set to form a strong, conductive, stone-like mortar after fracturing a source rock. The mortar slurry may simultaneously create and fill fractures, allowing hydrocarbons therein to escape. As the mortar slurry hardens into a mortar, the fractures may remain open, allowing the hydrocarbons to flow into a drilling pipe, so long as the mortar is permeable. Such mortar slurry may reduce or eliminate the need for proppants, which can be expensive and are sometimes unable to maintain initial conductivity. Further, enhanced conductivity through use of a mortar slurry as a fracturing agent, without large amounts of dissolvable materials, gelling agents, foaming agents, and the like may provide a safer, cheaper, more efficient treatment option as compared with conventional methods.

Treatments using the methods described herein may include stimulation, formation stabilization, and/or consolidation. Stimulation using the methods described below may involve use of a mortar slurry in place of traditional fluids such as slick water, linear gel or cross-link gel formulations carrying solid proppant material. The mortar slurry may create the fractures in a target formation zone before hardening into a permeable mortar and becoming conductive, allowing reservoir fluids to flow into the wellbore. Thus, the mortar slurry may serve as the fracturing fluid and proppant material. The mortar slurry may become conductive after hydration such that the fracture geometry created may be conductive without need for a separate proppant. Furthermore, fracture coverage may be increased, resulting in an improved fracture length as a result of more contact area, and corresponding increase in well spacing. In some instances, the well spacing may be doubled, reducing wells by 50%. Further, stimulation costs may be significantly reduced. Additionally, the use of water may be reduced, as the mortar slurry may require up to 70%-75% less water than a traditional slick water fracturing operation.

The mortar slurry may reach and sustain high design fracture conductivity through (1) management of cracking in a mortar formed by the mortar slurry as the mortar is stressed by the closing formation; (2) management of the conductivity of the mortar slurry as it sets to form a pervious mortar; or (3) both. By managing cracking in the mortar, a conductive media may be generated via cracks due to the minimum in situ stress acting on the mortar. Such cracks may form a free path for fluid flow, thus making the cracked mortar a conductive media even if the mortar was less conductive or even relatively nonconductive prior to cracking. The conductivity of the mortar slurry may be managed during setting to form a pervious mortar by providing the mortar slurry with a sand/cementitious material ratio higher than one. Conductivity may be created by agglomeration of sand grains cemented during hydration by choosing a recipe that creates pores in the mortar. The agglomeration may occur as a result of the sand grains being precoated, or as a result of the mix of mortar slurry. Finally, in a mortar having a particular conductivity, managing cracking of a pervious mortar may allow for further enhanced conductivity. Thus, conductivity may be provided via a pervious mortar that is not cracked, via an essentially non-pervious mortar that is cracked, or via a pervious mortar that is cracked.

In one embodiment, a method of treating a subterranean formation involves the use of a mortar slurry designed to form a solid mortar designed to crack under a fracture closure pressure. In other words, the mortar slurry may have components in various ratios such that, upon setting, the resulting mortar will have a compressive strength that is less than the closure pressure of the fracture after external pressure has been removed. Thus, when external pressure is removed after the mortar slurry has set and formed the mortar, the fracture closure pressure will compress the mortar. Because the compressive strength of the mortar is less than the fracture closure pressure, such compression will result in a particular degree of cracking of the mortar, causing the permeability of the mortar to be enhanced.

Permeability in cured mortar resulting from voids within the matrix of the mortar is referred to as primary permeability. When the cured mortar is cracked, for example, but application of formation stress that exceeds the compressive strength of the mortar creates secondary permeability. Creation of secondary permeability will increase the total permeability of the cured mortar. Secondary permeability may also be created by including in the mortar slurry components that, after curing of the mortar, either shrink or expand. Components that shrink create additional voids, and also weaken the matrix, resulting in additional cracking when formation stresses are applied. Components that expand after curing of the mortar will result in the cured mortar changing dimensions within the fracture and cause cracks, resulting in secondary permeability.

The present invention may rely on primary permeability in the cured mortar, or may utilize one of the methods taught herein to additionally create secondary permeability, or may utilize a relatively impermeable mortar, and rely on secondary permeability created upon or after curing of the mortar slurry in the fracture.

The methods of treatment described herein may be useful for fracturing, re-fracturing, or any other treatment in which conductivity of a fracture or wellbore is desired. The mortar slurry (liquid phase and solid phase or both or partials of both) may be prepared (e.g., "on the fly" or by a pre-blending process) and placed into the subterranean formation at a pressure sufficient to create a fracture in the subterranean formation. The equipment and process for mixing the components of the mortar slurry (e.g., aggregate, cementitious material, and water) may be batch, semi-batch, or continuous and may include cement pumps, frac pumps, free fall mixers, jet mixers used in drilling rigs, pre-mixing of dried materials (batch mixing), or other equipment or methods. In some embodiments, the placement of the mortar slurry in the subterranean formation is accomplished by injecting the mortar slurry with pumps at pressures up to 30,000 psi. Injection can be done continuously or in separate batches. Rates of up to about 12 $m^3$/min may be desirable with through tube diameter of up to about 125 mm and through perforations up to about 1,202.7 mm. Once at least one fracture has been created in the subterranean formation, the pressure will desirably be maintained at a pressure higher than the fracture closure pressure, allowing the mortar slurry to set and form a stone-like mortar. Fracture closure pressure can be obtained from specialized test such micro fracs, mini fracs, leak-off test or from sonic and density log data.

So long as pressure does not drop below the fracture closure pressure between the time the fracture is created and the time the mortar slurry has set, the mortar slurry will fill and form the mortar in the fracture. Once the mortar slurry has set to form the mortar, the pressure can be reduced below the fracture closure pressure, and the mortar in the fracture may be allowed to crack, forming a cracked mortar. In order to ensure cracking of the mortar, the mortar slurry may be designed to set to form a mortar with a compressive strength at or below the fracture closure pressure of the subterranean formation. Additional design compressive strengths of the mortar may be appropriate, depending on the types and amounts of various materials used in the mortar slurry. The compressive strength may be greater than Fracture Closure−0.5*Reservoir Pressure. This is normally called effective proppant stress or effective confinement stress. In one embodiment, cracks will be induced by the effect of closure pressure but will not lose integrity as the strength of the mortar is desirably higher than the effective confinement stress. In other words, the compressive strength of the mortar may be any value between the closure pressure and the effective confinement stress, such that the mortar will crack, but not fail, when exposed to closure pressure. For example, if the fracture closure pressure of a particular formation is 8,000 psi and the reservoir pressure is 6,500 psi, the effective confined stress is 8,000−0.5*6,500=4,750 psi, one desirable permeable mortar might have a compressive strength below 8,000 psi, and higher than 4,750 psi. Formations may exert much higher point or line loadings than anticipated on the basis of compressive strength estimates, and those loadings may induce the desired cracking as well. One having ordinary skill in the art will appreciate that the exact compressive strength of the mortar can be selected based on a number of factors, including extent of cracking or permeability desired, cost of materials, flowability, well choke policy, and the like.

In some embodiments, the mortar slurry may be designed to provide a pervious mortar with a compressive strength above the expected fracture closure pressure. In such embodiments, selection of materials may ensure sufficient conductivity of the pervious mortar without reliance on cracking of the mortar to provide conductivity.

Whether the mortar slurry is designed such that the mortar cracks or not, the mortar slurry may be designed to ensure that the mortar maintains at least some integrity in the fracture. Thus, various designs of the mortar slurry result in a mortar that has a maximum compressive strength, a minimum compressive strength, or both. A particular mortar slurry provides a mortar that cracks because the maximum compressive strength is sufficiently low, yet maintains structural integrity because the minimum compressive strength is sufficiently high. Stated another way, the mortar may crack while remaining in place and serving as a proppant. The degree to which the mortar may crack may be chosen based on maximizing conductivity, such that there are enough cracks to ensure flow therethrough, but not so many cracks that the mortar breaks into small pieces and blocks or otherwise becomes a hindrance to wellbore operations.

In order to maintain the desired integrity in the fracture, the mortar may have a compressive strength above an effective confinement stress of the formation or above fracture closure if cracking of the mortar is not desired (e.g., if the mortar is a pervious mortar having sufficient permeability without cracking). Additionally, the mortar may have strength sufficient to hold on pressure cycles due to temporary well shutoffs due to maintenance or other operational reasons. In some embodiments, the mortar may have a compressive strength of about 20 MPa when the postulated fracture closure pressure is about 40 MPa, such that the fracture closure pressure will cause the mortar to crack without being destroyed.

After a permeable mortar has formed in the wellbore as a result of the use of a pervious mortar, as a result of cracking of the mortar, or as a result of both, hydrocarbons may be produced from the formation, with the permeable mortar acting to maintain the integrity of the fracture within the formation while allowing the hydrocarbons and other formation fluids to flow into the wellbore. Produced hydrocarbons may flow through the permeable mortar and/or induced cracks while formation sands may be substantially prevented from passing through the permeable mortar.

The mortar slurry includes cementitious material and water. The water may be present in an amount sufficient to form the mortar slurry with a consistency that can be pumped. More particularly, a weight ratio between the water and the cementitious material may be between 0.2 and 0.8, depending on a variety of desired characteristics of the mortar slurry. For example, more water may be used when less viscosity is desired and more cementitious material or less water may be used when strength is desired. Additionally, the ratio of water to cementitious material may be varied depending on whether other materials are used in the mortar slurry. The particular materials used in the mortar slurry may be selected based on flowability, and homogeneity.

A variety of cementitious materials may be suitable, including hydraulic cements formed of calcium, aluminum, silicon, oxygen, iron, and/or aluminum, which set and harden by reaction with water. Hydraulic cements include, but are not limited to, Portland cements, pozzolanic cements, gypsum cements, high alumina content cements, silica cements, high alkalinity cements, micro-cement, slag cement, and fly ash cement. Some cements are classified as Class A, B, C, G, and H cements according to American Petroleum Institute, API Specification for Materials and Testing for Well Cements, API Specification 10, Fifth Ed., Jul. 1, 1990. Other cement types and compositions that may be suitable are set forth in the European standard EN 197-1, which consists of 5 main types. Of those, Type II is divided into seven subtypes based on the type of secondary material. The American standard ASTM C150 covers different types of Portland cement and ASTM C595 covers blended hydraulic cements. The cementitious material may form about 20% to about 90% of the weight of the mortar slurry.

The water in the mortar slurry may be fresh water, salt water (e.g., water containing one or more salts dissolved therein), brine (e.g., saturated salt water), brackish water, flow-back water, produced water, recycle or waste water, lake water, river, pound, mineral, well, swamp, or seawater. Generally, the water may be from any source provided it does not contain an excess of compounds that adversely affect other components in the mortar slurry. The water may be treated to ensure appropriate composition for use in the mortar slurry.

In some embodiments, the mortar slurry may be designed to provide a pervious mortar with a minimum level of conductivity. For example, the mortar slurry may be designed to set to form a pervious mortar with conductivity from about 10 mD-ft to about 9,000 mD-ft, from about 250 mD-ft to about 1,000 mD-ft, above 100 mD-ft, or above 1,500 mD-ft using gap-graded aggregates, cracking, or both.

The mortar slurry may provide the mortar with the minimum level of conductivity without resorting to certain materials that may be expensive, harmful to the environment, difficult to transport, or otherwise undesirable. In other words, the mortar slurry may essentially exclude certain materials. For example, in some cases, gelling agents, breakers, foaming agents, surfactants, additional viscofiers, and/or degradable materials may be entirely omitted from the mortar slurry, or included in only minimal amounts. Thus, the mortar slurry may include less than 5% gelling agents, less than 5% foaming agents, less than 5% surfactants, and/or less than 5% degradable material based on the weight of the cementitious material in the mortar slurry. For example, the mortar slurry may include less than 4%, less than 3%, less than 2%, less than 1%, less than 0.5%, less than 0.1%, or trace amounts of any of these materials based on the weight of the cementitious material in the mortar slurry.

The mortar slurry may further include aggregate. Some examples of aggregates include standard sand, river sand, crushed rock (such as basalt, lava/volcanic rock, etc.) mineral fillers, and/or secondary or recycled materials such as limestone grains from demineralization of water and fly ash. Other examples include poly-disperse, new, recycle or waste stream solid particles, ceramics, crushed concrete, spent catalyst (e.g., heavy metal leach), and glass particles. Lightweight additives such as bentonite, pozzolan, or diatomaceous earth may also be provided. The aggregate may have a grain size of 0 to 2 mm, 0 to 1 mm, possibly 0.1 to 0.8 mm. The sand/cementitious material ratio may influence mechanical properties of the mortar, such as compressive and flexural strength, as well as the workability, porosity, and permeability of the mortar slurry. The ratio between the sand and the cementitious material may be between 1 and 8, between 1 and 6, or between 2 and 4. In some embodiments, gap-graded aggregates may be used. Thus, particular ratios of various grain sizes may be selected based on the unique characteristics of each, such that voids are intentionally created in the mortar slurry as it is pumped into the wellbore and sets to form the mortar. Thus, gap-graded aggregates may provide for a void content of the mortar of about 20%, either prior to or after the mortar has cracked to form a permeable mortar. Mixing angularities of particles may allow for better packing mixtures. For example, natural material such as sand with low or high angularity may be used either alone or in conjunction with other materials having similar or dissimilar angularities. When the designed void content is sufficiently high, the mortar may be designed to have a compressive strength higher than the fracture closure pressure. Thus, with gap-graded aggregates, a higher degree of integrity of the mortar may be obtained while allowing for sufficient conductivity. However, if additional conductivity is desired, the gap-graded aggregate may be used in conjunction with the mortar designed to crack under fracture closure pressure, creating an even higher conductivity. Sand grains in some embodiments may be coated with a cement-based mixture by means of pre-hydration to eliminate sagging and keep the mortar slurry as a single phase liquid; additionally, one may further add a thickening agent or other common solid suspension additive as well as different improvement admixtures to the mortar slurry.

The mortar slurry may include binders such as, but not limited to, Portland cement of which CEM 152.5 R is a very rapidly hardening example, or others such as MICRO-CEM®, a special cement with a very small grain size distribution (<10 μm). The latter has very small cement particles and therefore a very high specific surface (i.e., Blaine value), as such it is possible to get very high strengths at an early time. Other cementitious materials such as clinker, fly ash, slag, silica fume, limestone, burnt shale, possolan, and mineral binders may be used for binding.

The mortar slurry may include admixtures of plasticizers or superplasticizers and retarders. Superplasticizers may include, but are not limited to, poly-carboxylate ethers of which a commercial example is BASF Glenium ACE 352 (active component=20% m/m) and/or sulfonated naphthalene formaldehyde condensates of which a commercial example is Cugla PIB HR (active component=35% m/m). Retarders may include, but are not limited to, standard retarders for cement applications known in the art of which commercial examples include CUGLA PIB MMV (active component=25% m/m) and/or BASF Pozzolith 130R (active component=20% m/m).

Optionally, a dispersant may be included in the mortar slurry in an amount effective to aid in dispersing the cementitious and other materials within the mortar slurry. For example, dispersant may be about 0.1% to about 5% by weight of the mortar slurry. Exemplary dispersants include naphthalene-sulfonic-formaldehyde condensates, acetone-formaldehyde-sulfite condensates, and flucano-delta-lactone.

A fluid loss control additive may be included in the mortar slurry to prevent fluid loss from the mortar slurry during placement. Examples of liquid or dissolvable fluid loss control additives include modified synthetic polymers and copolymers, natural gum and their derivatives and derivatized cellulose and starches. If used, the fluid loss control additive generally may be included in a resin composition in an amount sufficient to inhibit fluid loss from the mortar slurry. For example, the fluid loss additive may form about 0% to about 25% by weight of the mortar slurry.

Other additives such as accelerators (e.g., calcium chloride, sodium chloride, triethanolaminic calcium chloride, potassium chloride, calcium nitrite, calcium nitrate, calcium formate, sodium formate, sodium nitrate, triethanolamine, X-seed (BASF), nano-$CaCO_3$, and other alkali and alkaline earth metal halides, formates, nitrates, carbonates, admixtures for cement specified in ASTM C494, or others), retardants (e.g., sodium tartrate, sodium citrate, sodium gluconate, sodium itaconate, tartaric acid, citric acid, gluconic acid, lignosulfonates, and synthetic polymers and copolymers, thixotropic additives, soluable zinc or lead salts, soluble borates, soluble phosphates, calcium lignosulphonate, carbohydrate derivates, sugar based admixtures (such as lignine), admixtures for cement specified in ASTM C494, or others), suspending agents, surfactants, hydrophobic or hydroliphic coatings, PH buffers, or the like may also be in the mortar slurry. Additional additives may include fibers for strengthening or weakening, either polymeric or natural such as cellulose fibers. Cracking additives may also be included. Some cracking additives may include expansive materials (e.g., gypsum, calcium sulfo-aluminate, free lime (CaO), aluminum particles (e.g., metallic aluminum), reactive silica (e.g., coarse; on long term), etc.), shrinking materials, cement contaminants (e.g., oil, diesel), weak spots (e.g., weak aggregates, volcanic aggregates, etc.), non bonding aggregates (e.g., plastics, resin coated proppant, biodegradable material).

In some embodiments, e.g., stimulation of a consolidated or semi-consolidated formation, conventional proppant material may be added to the mortar slurry. As used herein, the terms "consolidated" and "semi-consolidated" refer to formations that have some degree of relative structural stability as opposed to an "unconsolidated" formation, which has relatively low structural stability. When subjected to a fracturing procedure, such formations may exert very high fracture closure stresses. The proppant material may aid in maintaining the fractures propped open. If used, the proppant material may be of a sufficient size to aid in propping the fractures open without negatively affecting the conductivity of the mortar. The general size range may be about 10 to about 80 U.S. mesh. The proppant may have a size in the range from about 12 to about 60 U.S. mesh. Typically, this amount may be substantially less than the amount of proppant material included in a conventional fracturing fluid process.

The mortar slurry may further have glass or other fibers, which may bind or otherwise hold the mortar together as it cracks, limestone, or other filler material to improve cohesion (reduce segregation) of the mortar slurry, or any of a number of additives or materials used in downhole operations involving cementitious material.

The mortar slurry may set to form a pervious mortar in a fracture in a subterranean formation to, among other things, maintain the integrity of the fracture, and prevent the production of particulates with well fluids. The mortar slurry may be prepared on the surface (either on the fly or by a pre-blending process), and then injected into the subterranean formation and/or into fractures or fissures therein by way of a wellbore under a pressure sufficient to perform the desired function. When the fracturing or other mortar slurry placement process is completed, the mortar slurry is allowed to set in the formation fracture(s). A sufficient amount of pressure may be required to maintain the mortar slurry during the setting period to, among other things, prevent the mortar slurry from flowing out of the formation fractures. When set, the pervious mortar may be sufficiently conductive to allow oil, gas, and/or other formation fluids to flow therethrough without allowing the migration of substantial quantities of undesirable particulates to the wellbore. Moreover, the pervious mortar may have sufficient compressive strength to maintain the integrity of the fracture(s) in the formation.

The mortar may have sufficient strength to substantially act as a propping agent, e.g., to partially or wholly maintain the integrity of the fracture(s) in the formation to enhance the conductivity of the formation. Importantly, while acting as a propping agent, the mortar may also provide flow channels within the formation, which facilitate the flow of desirable formation fluids to the wellbore. The cracked mortar, while lacking sufficient strength to avoid cracking under fracture closing pressure, may also have sufficient strength to act as a propping agent. In some embodiments, the permeable mortar (i.e., pervious mortar, cracked mortar, or cracked pervious mortar) may have a permeability ranging from about 0.1 darcies to about 430 darcies; in other embodiments, the permeable mortar may have a permeability ranging from about 0.1 darcies to about 50 darcies; in still other embodiments, the permeable mortar may have a permeability of above about 10 darcies, or above about 1 darcy.

When cracking of the mortar is not specifically desired, the methods described above may optionally omit the steps of maintaining a pressure higher than the fracture closure pressure while allowing the mortar slurry to set, and allowing the mortar in the fracture to crack and form a cracked mortar. If such steps are not omitted or are only partially omitted, the mortar may still crack and form the cracked mortar, resulting in enhanced conductivity. However, if cracking is desired, such steps may ensure managed cracking occurs.

Slugs of mortar slurry and proppant laden gel may increase connectivity between cracked mortar locations within the fractures using the proppant and gel sections as connectors. The sections of cracked mortar may provide support for vertical placement of high conductivity material in the fracture. The treatment may be completed at the end with proppant and fluid for better near wellbore conductivity. Low and high frequency and ratio of cracked mortar and gel may depend on equipment capability to cycle between two systems.

In order to provide for efficient pumping and other working of the mortar slurry, the mortar slurry may be designed to flow in accordance with particular limitations of the worksite. Thus, taking into account variables such as temperature, depth of the wellbore and other formation characteristics, the flowability radius may be adjusted. The mortar slurry viscosity, measured by viscometers standard equipment known to the skilled person such a Fann-35 (by Fann Instrument Company of Houston Tex.), may be less than 5,000 cP, or less than 3,000 cP, potentially below 1,000 cP. Likewise, the mortar slurry may be designed to set in accordance with particular limitations of the worksite. Thus, taking into account variables such as temperature, depth of the wellbore, other formation characteristics, the setting time may be adjusted. In some embodiments, the setting time of the mortar slurry may be at least 60 minutes after pump shut in. In other embodiments, the setting time of the mortar slurry may be between 2 hours and 6 hours after pump shut in, about 3 hours after pump shut in, or another setting time allowing for placement of the mortar slurry without undesirable delay after placement and before setting. When a setting time has been selected, the method of treating the subterranean formation may include allowing the mortar slurry to set by waiting the designed set time. For example, when the setting time of the mortar slurry is 60 minutes, the method may include waiting at least 60 minutes after injecting stops. A person skilled in the art will appreciate that certain retarder technologies may affect the mortar slurry strength development which may be taken into account and compensated for.

Upon setting of the mortar slurry, the mortar (e.g., a pervious mortar) may have a conductivity above 100 mD-ft, and the mortar slurry may be designed to provide such conductivity in the mortar. Prior to cracking, a pervious mortar may have a first conductivity. Such conductivity may result from a continuous open pore structure and/or cracks formed in the pervious mortar. After cracking of the pervious mortar, the cracked pervious mortar may have a higher conductivity because of the void space created by the cracks. For example, cracking may provide cracks having widths of about 0.5 mm. Thus, a second conductivity of the pervious mortar may be greater than the first conductivity of the pervious mortar prior to cracking. For example, the first conductivity may be at least 100 mD-ft, and the second conductivity may be at least 250 mD-ft. The second conductivity may be a degree or percentage greater than the first conductivity. For example, the second conductivity may be at least 25 mD-ft, 50 mD-ft, 100 mD-ft, 250 mD-ft, 500 mD-ft, or 1,000 mD-ft greater than the first conductivity. These values may apply to confinement stress of up to about 15,000 psi, with different values applicable to different applied net pressure.

Upon setting of the mortar slurry, the mortar may have a salinity tolerance above 3% brine, and the mortar slurry may be designed to provide such salinity tolerance in the mortar. For example, the salinity tolerance may be between about 1% brine and about 25% brine. A person skilled the art may appreciate that with high salinity or alkali content, some aggregates may show unwanted alkali-silica reactivity and hence such materials are not preferred here.

The mortar slurry may be designed with a setting temperature of about 50° C. to about 330° C., designed with a setting temperature of below 150° C., or designed with a setting temperature of above 150° C.

In one embodiment, the mortar slurry may be formed of 27.7 wt % Portland cement, 13.9 wt % in ground water, 55.4 wt % 0-1 mm sand, 1.7 wt % retarder, and 1.3 wt % superplasticizer.

In one particular embodiment, the mortar slurry and mortar may be designed with some or all of the following characteristics:

| Property | Value |
|---|---|
| Confinement stress (at 20 hours after setting) | 42-85 MPa |
| Conductivity | 250-1,000 mD-ft (with a crack width of 3 mm) |
| Setting time | 2 hours |
| Setting temperature | 60-200° C. |
| Salinity tolerance | 3-10% Brine |
| Pumping rates | Up to 10 $m^3$/min |
| Tube diameter | 127 mm |
| Tube perforations | 12.7 mm |

EXAMPLES

In one test under ambient conditions (i.e., 20° C.), a mixture using the components below with a water/cement ratio of 0.35 resulted in a mortar having the properties following.

| Component | % m/m | Kg/$m^3$ (assuming 4% V/V air content) |
|---|---|---|
| CEM I 52.5 R | 28.8 | 658 |
| Concrete sand 0-1 mm | 57.6 | 1,317 |
| Water | 10.1 | 231 |
| Cugla MMV | 0.56 | 12.8 |
| BASF Glenium | 0.55 | 12.6 |

| Property | Value |
|---|---|
| Compressive strength (after 16 hours) | 36 MPa |
| Compressive strength (after 24 hours) | 48 MPa |
| Flexural strength (after 16 hours) | 6 MPa |
| Flexural strength (after 24 hours) | 7 MPa |

method, with water column height about 0.4 m. The specimen exhibited good flowability and setting behavior, with compressive strength after 16-24 hours being between 25 MPa and 30 MPa (at 80° C.). Compressive strength in this range was sufficiently weak to crack under the assumed fracture closing pressure with conductivity between 150 mD-ft and 2,200 mD-ft, as indicated below.

| | | |
|---|---|---|
| Cement CEM I 52.5 R | 19.98% m/m | 22.46% m/m |
| Water | 12.91% m/m | 12.57% m/m |
| Concrete sand 0-1 mm | 55.33% m/m | 53.89% m/m |
| Limestone filler | 9.22% m/m | 8.98% m/m |
| Cugla MMV | 0.86% m/m | 0.84% m/m |
| BASF Glenium | 1.25% m/m | 1.26% m/m |
| Glass fibers | 0.40% m/m | 0.00% m/m |
| Sand/cement ratio | 2.77 | 2.40 |
| Water (total)/cement ratio | 0.73 | 0.63 |
| Segregation | No | No |
| Flowability (after 0 minutes) | 180 mm without vibration >300 mm with low intensity vibration of flow table | 260 without vibration >300 mm with low intensity vibration of flow table |
| Flowability (after 60 minutes) | 120 mm without vibration >300 mm with low intensity vibration of flow table | 280 mm without vibration >300 mm with low intensity vibration of flow table |
| Setting time (min) | >75 | >75 |
| Compressive strength (after 16 hours) | 26 MPa | 25 MPa |
| Compressive strength (after 24 hours) | 31 MPa | 27 MPa |
| Conductivity - small cracks (up to 0.6 mm) | 150 mD-ft | 150 mD-ft |
| Conductivity - wide cracks (up to 3.0 mm) | 2,200 mD-ft | 2,200 mD-ft |

-continued

| Property | Value |
|---|---|
| Flowability (after 0 minutes) | >300 mm |
| Flowability (after 30 minutes) | >300 mm |
| Flowability (after 60 minutes) | >300 mm |
| Setting time | >120 minutes |

In another test, a mixture using the materials below with a water/cement ratio of 0.35 resulted in a mortar having the properties following.

| Component | % m/m | Kg/m$^3$ (assuming 4% V/V air content) |
|---|---|---|
| MICROCEM® | 29.7 | 667 |
| Concrete sand 0-1 mm | 59.4 | 1,335 |
| Water | 10.4 | 234 |
| BASF Pozzolith | 0.26 | 5.8 |
| BASF Glenium | 0.28 | 6.3 |

| Property | Value |
|---|---|
| Compressive strength (after 16 hours) | 64 MPa |
| Compressive strength (after 24 hours) | 84 MPa |
| Flexural strength (after 16 hours) | 7 MPa |
| Flexural strength (after 24 hours) | 8 MPa |
| Flowability (after 0 minutes) | 300 mm |
| Setting time | 15 minutes |

In yet another test, a mixture using the materials below resulted in a mortar that met the strength requirement of at least 42 MPa at 20° C., 50° C., and 80° C., and at 24 hours at 80° C. had a compressive strength in excess of 80 MPa.

In a cracked mortar test of two samples, conductivity was measured at room temperature using the falling head In another test, conductivity was measured at room temperature using the falling head method with water column height about 0.4 m. The specimen showed proper conductivity when interpolated to 80° C. and using gas as a medium. Compressive strength was below the minimum value specified, indicating likelihood that cracking would occur, hence increasing conductivity, as indicated below.

| | | |
|---|---|---|
| Sand grain size | 0.5-1.6 mm | 1-2 mm |
| Cement CEM I 52.5 R | 18.6% m/m | 18.4% m/m |
| Water | 5.6% m/m | 6.9% m/m |
| Concrete sand 0-1 mm | 74.4% m/m | 73.4% m/m |
| Cugla MMV | 0.6% m/m | 0.6% m/m |
| BASF Glenium | 0.9% m/m | 0.9% m/m |
| Sand/cement ratio | 4.0 | 4.0 |
| Water (total)/cement ratio | 0.36 | 0.43 |
| Segregation | No | No |
| Flowability (after 0 minutes) | 150 mm | 150 mm |
| Setting time (minutes) | >60 | >60 |
| Compressive strength | 30 MPa | 12 MPa |
| Conductivity | 26 mD-ft | 75 mD-ft |

In light of the various tests, it is believed that at least the following ranges (% m/m) of compositions would be suitable for a mortar slurry designed to form a substantially non-pervious mortar:

| | Range | Preferred Range | Specific Example |
|---|---|---|---|
| Cement | 15-40 | 20-29 | 20 |
| Lime stone filler | 15-30 | 20 | 20 |
| Water | 5-30 | 10-14 | 11 |
| Sand | 20-70 | 48-60 | 48 |
| Superplasticizer | 0-3 | 0.3-1.4 | 1.3 |
| Retarder | 0-3 | 0-1.8 | 0 |
| Glass fibers | 0-5 | 0.54 | 0 |

-continued

| | Range | Preferred Range | Specific Example |
|---|---|---|---|
| W/C ratio | 0.3-0.8 | 0.4-0.7 | 0.60 |
| S/C ratio | 0.5-8 | 2-3 | 2.4 |

In light of the various tests, it is believed that at least the following ranges of compositions would be suitable for a mortar slurry designed to form a pervious mortar:

| | Range | Preferred Range | Specific Example |
|---|---|---|---|
| Cement | 10-40 | 14-41 | 14 |
| Lime stone filler | 0 | 0 | 0 |
| Water | 5-20 | 5-15 | 5 |
| Sand | 40-85 | 40-81 | 81 |
| Superplasticizer | 0-3 | 0.3-1.9 | 0.3 |
| Retarder | 0-3 | 0-2.5 | 0 |
| Glass fibers | 0 | 0 | 0 |
| W/C ratio | 0.3-0.8 | 0.4-0.6 | 0.40 |
| S/C ratio | 0.5-8 | 1-6 | 6.0 |

In light of the various tests, it is believed that at least the following ranges would be suitable for a mortar slurry designed with pre-hydrated precoated sand:

| | Range | Preferred Range |
|---|---|---|
| W/C ratio (by weight) | 0.05-0.50 | 0.15-0.30 |
| S/C ratio (by weight) | 1-10 | 3-6 |

Those of skill in the art will appreciate that many modifications and variations are possible in terms of the disclosed embodiments, configurations, materials, and methods without departing from their scope. Accordingly, the scope of the claims and their functional equivalents should not be limited by the particular embodiments described and illustrated, as these are merely exemplary in nature and elements described separately may be optionally combined.

That which is claimed is:

1. A method of treating a subterranean formation, comprising:

designing a mortar slurry to set to form a mortar with a compressive strength between 12 MPa and 84 MPa and that is also below a fracture closure pressure of the subterranean formation and above an effective confinement stress, the mortar slurry comprising a cementitious material, water, and sand, wherein the ratio between the sand and the cementitious material in the mortar slurry is from 0.5 to 2.0 parts sand per part of cementitious material by weight;

preparing the mortar slurry;

injecting the mortar slurry into the subterranean formation at a pressure sufficient to create a fracture in the subterranean formation;

while maintaining a pressure higher than the fracture closure pressure, allowing the mortar slurry to set, forming the mortar in the fracture;

reducing the pressure below the fracture closure pressure; and allowing the mortar in the fracture to crack due to fracture closure pressure, forming a cracked mortar, wherein, prior to allowing the mortar in the fracture to crack, the mortar comprises a pervious mortar having a first conductivity, and wherein the cracked mortar has a second conductivity at least 25 mD-ft greater than the first conductivity.

2. The method of claim 1, wherein the mortar slurry is further designed to have a viscosity of less than 5,000 cP.

3. The method of claim 1, wherein the mortar slurry is further designed to set to form the mortar with a setting time in excess of 60 minutes after pump shut in, and wherein allowing the mortar slurry to set comprises waiting at least 60 minutes after injecting stops.

4. The method of claim 1, wherein the mortar slurry is further designed to set to form a pervious mortar with a conductivity from 25 mD-ft to 2200 mD-ft.

5. The method of claim 1, wherein the mortar slurry is further designed to set and form the mortar with a salinity tolerance above 1% brine.

6. The method of claim 1, wherein a design ratio between the water and the cementitious material is between 0.2 and 0.8.

7. A method of treating a subterranean formation, comprising:

designing a mortar slurry to set to form a pervious mortar with conductivity between 25 mD-ft and 2200 mD-ft, with a compressive strength between 12 MPa and 84 MPa and that is also below a fracture closure pressure of the subterranean formation and above an effective confinement stress, the mortar slurry comprising a cementitious material, water, and aggregate, wherein the aggregate comprises sand and the ratio between the sand and the cementitious material in the mortar slurry is from 0.5 to 2.0 parts sand per part cementitious material by weight;

preparing the mortar slurry;

injecting the mortar slurry into the subterranean formation at a pressure sufficient to create a fracture in the subterranean formation and maintaining a pressure on the mortar slurry high enough to prevent fracture closure long enough for the mortar slurry to set;

allowing the mortar slurry to set, forming the pervious mortar in the fracture; and allowing the mortar in the fracture to crack due to fracture closure pressure.

8. The method of claim 7, wherein the mortar slurry is further designed to have a viscosity of less than 5,000 cP.

9. The method of claim 7, wherein the mortar slurry is further designed to set to form the pervious mortar with a setting time in excess of 60 minutes after pump shut in, and wherein allowing the mortar slurry to set comprises waiting at least 60 minutes after injecting stops.

10. The method of claim 7, wherein the mortar slurry is designed to set to form the pervious mortar with a compressive strength above 20 MPa.

11. The method of claim 7, wherein the mortar slurry is further designed to set and form the pervious mortar with a salinity tolerance above 1% brine.

12. The method of claim 7, wherein a design ratio between the water and the cementitious material is between 0.2 and 0.8.

13. The method of claim 7, wherein the mortar slurry design further comprises retarder.

* * * * *